US012011100B1

(12) United States Patent
Zhou

(10) Patent No.: US 12,011,100 B1
(45) Date of Patent: Jun. 18, 2024

(54) OUTDOOR CHAIR WITH CUP HOLDER ASSEMBLY

(71) Applicant: Ruolin Zhou, Yuyao (CN)

(72) Inventor: Ruolin Zhou, Yuyao (CN)

( * ) Notice: Subject to any disclaimer, the term of this patent is extended or adjusted under 35 U.S.C. 154(b) by 0 days.

(21) Appl. No.: 18/237,430

(22) Filed: Aug. 24, 2023

(51) Int. Cl.

| | |
|---|---|
| ***A47C 7/62*** | (2006.01) |
| ***A47C 1/14*** | (2006.01) |
| ***A47C 4/08*** | (2006.01) |
| ***A47C 4/10*** | (2006.01) |

(52) U.S. Cl.
CPC ..... *A47C 7/624* (2018.08); *A47C 1/14* (2013.01); *A47C 4/08* (2013.01); *A47C 4/10* (2013.01); *A47C 7/622* (2018.08)

(58) Field of Classification Search
CPC .. A47C 7/624; A47C 1/14; A47C 4/08; A47C 4/10; A47C 7/622
USPC ..... 297/188.14–188.17, 452.63
See application file for complete search history.

(56) References Cited

U.S. PATENT DOCUMENTS

| | | | | | |
|---|---|---|---|---|---|
| 2,490,884 | A * | 12/1949 | Rau | A47C 4/027 | 297/440.13 |
| 2,650,652 | A * | 9/1953 | Watson | A47C 4/14 | 297/31 |
| 4,417,764 | A * | 11/1983 | Marcus | B60N 2/793 | 297/188.17 |
| 4,635,998 | A * | 1/1987 | Hickey | A47C 4/08 | 297/39 |
| 4,707,023 | A * | 11/1987 | Hickey | A47C 4/08 | 297/39 |
| 4,976,492 | A * | 12/1990 | Ziegler | A47C 4/14 | 297/39 |
| 5,060,899 | A * | 10/1991 | Lorence | B60N 3/108 | 297/188.17 |
| 5,911,469 | A * | 6/1999 | Young | A47C 7/54 | 297/39 |
| 6,361,105 | B1 * | 3/2002 | Turner | A47C 7/62 | 297/16.2 |
| 9,532,654 | B1 * | 1/2017 | Adams, IV | A47C 7/68 | |
| D805,855 | S * | 12/2017 | Adams, IV | D7/620 | |
| 2015/0327675 | A1 * | 11/2015 | Fenner | A47B 83/02 | 297/148 |
| 2016/0220027 | A1 * | 8/2016 | Milde | A47C 1/14 | |
| 2019/0307253 | A1 * | 10/2019 | Pendleton, Jr. | A47C 7/624 | |

* cited by examiner

*Primary Examiner* — Robert Canfield
(74) *Attorney, Agent, or Firm* — Jose Cherson Weissbrot

(57) ABSTRACT

An Outdoor chair comprising a chair body, said chair body having front support leg on both sides, said front support leg having rear support leg extended laterally on the sides of said front support leg, said front support leg being connected to said rear support leg by means of a pivot axis, said front support leg being rotate and fold around the pivot axis, a recess and an arcuate mounting path being provided at the connection between said front support leg and said rear support leg, and said front support leg being provided with a large spacer corresponding to said recess, a small spacer sliding on said arcuate mounting path, the spacer being able to share the pressure borne by the bolt and reduce the friction between the bolt and the threaded hole.

17 Claims, 9 Drawing Sheets

OUTDOOR CHAIR WITH CUP HOLDER ASSEMBLY

TECHNICAL FIELD

The present invention relates to the technical field of chairs, in particular to an outdoor chair.

BACKGROUND

The chair legs on the market through the bolt connection with the chair body assembly, in the process of use, due to the bolt to withstand most of the pressure, the chair material is usually plastic and wood, bolt material is stainless steel, in a long period of time under the action of pressure, the two due to the chair shaking friction, the chair is easy to deformation of the chair threaded hole loosening, When threaded hole deformation occurs after the deformation of the loosening of the assembly of the chair legs and deformation occurs, When threaded hole is deformed and loosened, the assembly of the chair legs will also be deformed, and the bottom of the chair legs can not completely fit the floor, the chair will be a safety hazard, which will lead to the increase of the chair back plate tilt angle, and the chair legs will push up armrest, leading to the deformation of armrest.

Therefore, it is necessary to provide a chair that can share the pressure of the bolt, can provide higher support strength so that the chair is not easily deformed, and can loosen the threaded hole when the chair is used so that the assembly of the chair legs is more solid and gives the user a better experience of using the chair.

SUMMARY

The purpose of this utility model is to provide an outdoor chair that addresses the above deficiencies in the background technology.

In order to realise the above purpose, the present invention provides the following technical solution: An outdoor chair comprising a chair body, said chair body being provided with a front support leg on both sides, said front support leg having the front support leg extended on the side of said front support leg, said front support leg and said front support leg being connected by a pivot axis, said front support leg being rotatable and foldable around said pivot axis, wherein said front support leg is provided with a card slot and curved mounting paths at the junction of said front support leg and said front support leg, said front support leg is provided with a card slot and curved mounting paths at the junction of said front support leg and said front support leg, said front support leg is provided with a large spacer corresponding to said card slot and small spacers slidable on said curved mounting path.

Further, the chair body includes a chair seat, an armrest, a chair back, a support plate, a first fixing rod, a second fixing rod, a connecting rod, a first baffle, a second baffle, the chair back being provided on both sides with a side plate, a fixing block, a padded plate, the armrest and the chair seat being provided on both sides with a front support leg, a rear support leg, a support block.

Further, armrest consists of an armrest plate, an armrest support plate, a cup holder assembly, the armrest support plate is provided with a slot in the side wall of the armrest support plate, the cup holder assembly consists of a cup rest ring, a cup rest bottom, a connecting block, the cup rest bottom is connected to the underside of the cup rest ring by the connecting block, the Cup holder assembly consists of a cup holder ring, a cup holder base, the connecting block, the cup holder base is connected to underside of the cup holder ring by the connecting block, the cup holder ring is connected to pivot of the armrest plate, the cup holder ring is rotated by pivot into slot in side wall of the armrest support plate, the cup holder ring is hidden on underside of the armrest plate, the cup holder base is under the armrest support plate.

Further, the armrest support plate is connected to the front support leg by a swivel axis, and the front support leg can rotate about this axis to fold towards the back of the chair.

Further, the chair back is screwed to the first mounting bar, the chair back is screwed to the second mounting bar, the chair back being arranged along the length of the first mounting bar or the second mounting bar.

Further, the upper end of the side plate is fixedly connected to the second fixing bar and the lower end of the side plate is fixedly connected to the load bearing plate.

Further, the rear support leg is provided with a first groove, the load bearing plate is placed in the first groove, one end of the fixing block is connected to the rear support leg pivot, the other end of the fixing block is connected to the load bearing plate pivot, the rear support leg is rotatable about an axis, folded in the direction of the chair back, the rear support leg is screwed to the connecting rod, and the end face of the other end of the rear support leg is screwed to the first baffle.

Further, the armrest support plate is fixed to the lower surface of the armrest plate, the armrest support plate is provided with a padded plate between one end of the armrest support plate and the side plate, and a rotary shaft passes through the armrest support plate and the padded plate to be connected to the side plate.

Further, the support block is further secured to said front support leg for supporting the armrest plate, said front support leg is provided with a second groove, said second baffle is placed in said second groove of said front support leg, and said second baffle is bolted to said front support leg.

Further, the front support leg is provided with a first support rod, the first support rod extending downwardly along the upper surface of the front support leg to the lower surface of the front support leg along the entire height direction of the front support leg.

Further, the rear support leg is provided with a second support rod, the second support rod extending rearwardly along the upper surface of the rear support leg to the lower surface of the rear support leg along the entire length of the rear support leg.

Compared with the existing technology, the present invention has the following beneficial effects: outdoor chair of the present invention is provided with a spacer that can share the pressure of the bolt, so that the chair is not easy to deform the chair legs when using threaded hole, so that the assembly of the chair legs is more solid, and in the prolonged pressure, to reduce friction between the two due to the chair shaking and make the chair threaded hole easy to deform the chair loosening the situation, and the support rods are provided in the front support leg and rear support leg, which provide a higher support strength. Higher support strength, the bottom of the chair legs can be completely adhered to the ground when using outdoor chair, reducing the deformation of armrest and improving the user's experience.

BRIEF DESCRIPTION OF DRAWINGS

In order to explain the technical scheme of this application more clearly, the drawings needed in the implementation will be briefly introduced below. Obviously, the drawings described below are only some implementations of this application. For those skilled in the art, other drawings can be obtained according to these drawings without creative work.

In the figures: 1, chair back; 2, chair seat; 3, armrest; 4, front support leg; 5, support block; 6, rear support leg; 7, side plate; 8, second fixing rod; 9, first fixing rod; 10, load bearing plate; 11, connecting rod; 12, first baffle; 13, second baffle; 14, fixing block; 15, padded plate; 16, first groove; 17, second groove; 31, armrest plate; 32, armrest support plate; 41, small spacer; 42, large spacer; 61, slot; 62, curved mounting path; 71, first support rod; 81, second support rod; 311, connecting block; 312, cup resting ring; 313, cup resting bottom.

DESCRIPTION OF EMBODIMENTS

While various aspects and features of certain embodiments have been summarized above, the following detailed description illustrates a few exemplary embodiments in further detail to enable one skilled in the art to practice such embodiments. Reference will now be made in detail to embodiments of the inventive concept, examples of which are illustrated in the accompanying drawings. The accompanying drawings are not necessarily drawn to scale. The described examples are provided for illustrative purposes and are not intended to limit the scope of the invention. It should be understood, however, that persons having ordinary skill in the art may practice the inventive concept without these specific details.

It will be understood that, although the terms first, second, etc. may be used herein to describe various elements, these elements should not be limited by these terms. These terms are only used to distinguish one element from another. For example, a first attachment could be termed a second attachment, and, similarly, a second attachment could be termed a first attachment, without departing from the scope of the inventive concept.

It will be understood that when an element or layer is referred to as being "on," "coupled to," or "connected to" another element or layer, it can be directly on, directly coupled to or directly connected to the other element or layer, or intervening elements or layers may be present. In contrast, when an element is referred to as being "directly on," "directly coupled to," or "directly connected to" another element or layer, there are no intervening elements or layers present. Like numbers refer to like elements throughout. As used herein, the term "and/or" includes any and all combinations of one or more of the associated listed items.

As used in the description of the inventive concept and the appended claims, the singular forms "a," "an," and "the" are intended to include the plural forms as well, unless the context clearly indicates other.

Figure 1:
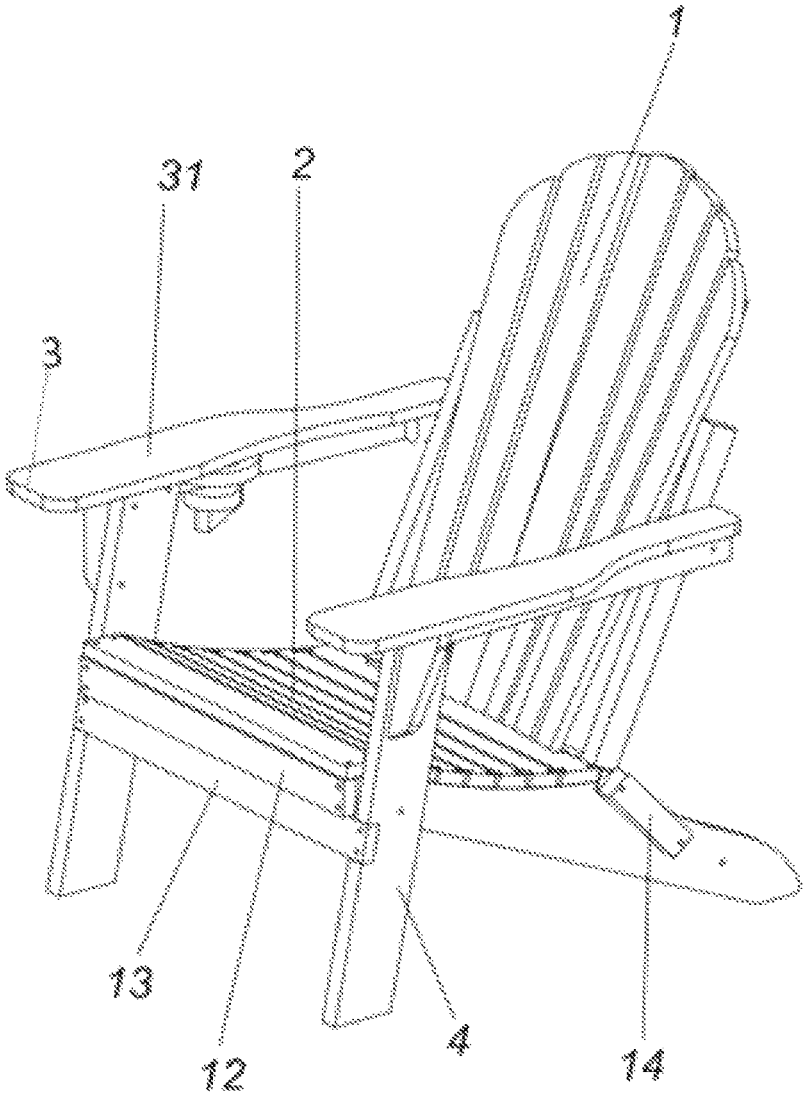
FIG. 1 is a three-dimensional view of the overall structure of an outdoor chair I.
Figure 2:
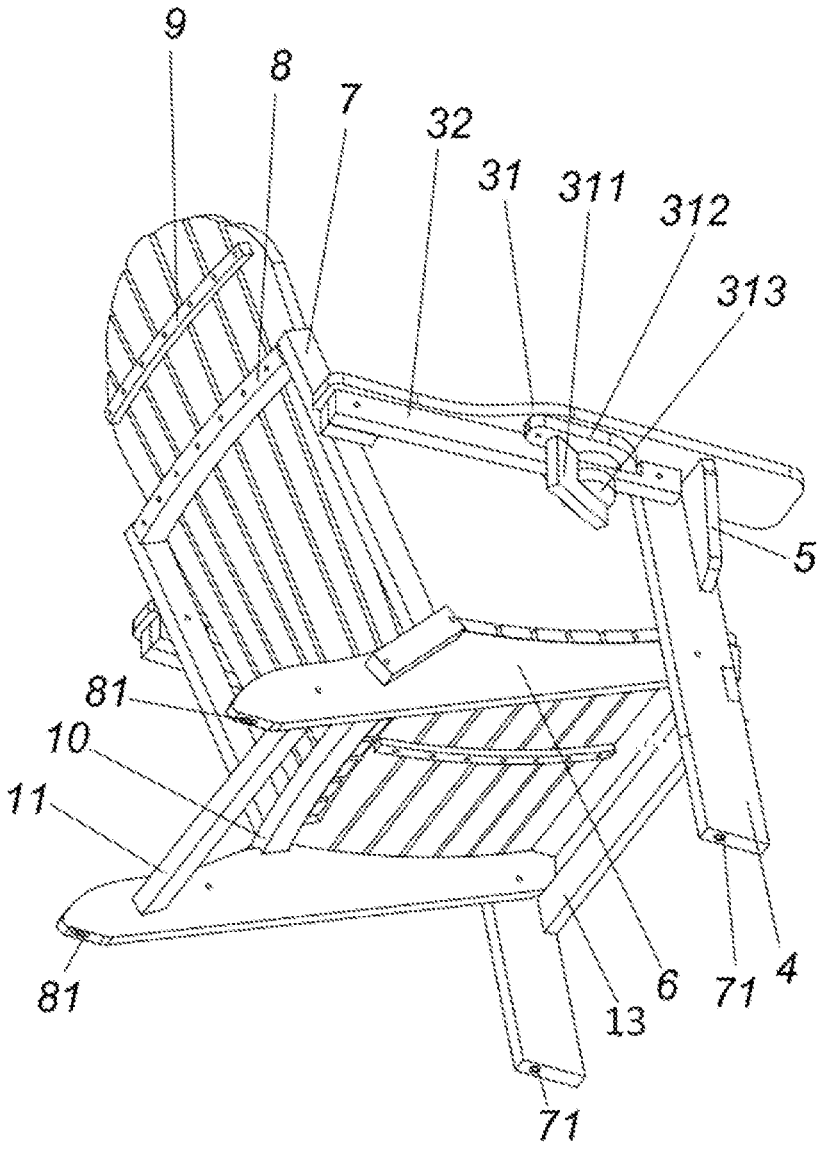
FIG. 2 is a three-dimensional view of the overall structure of an outdoor chair II.
Figure 3:
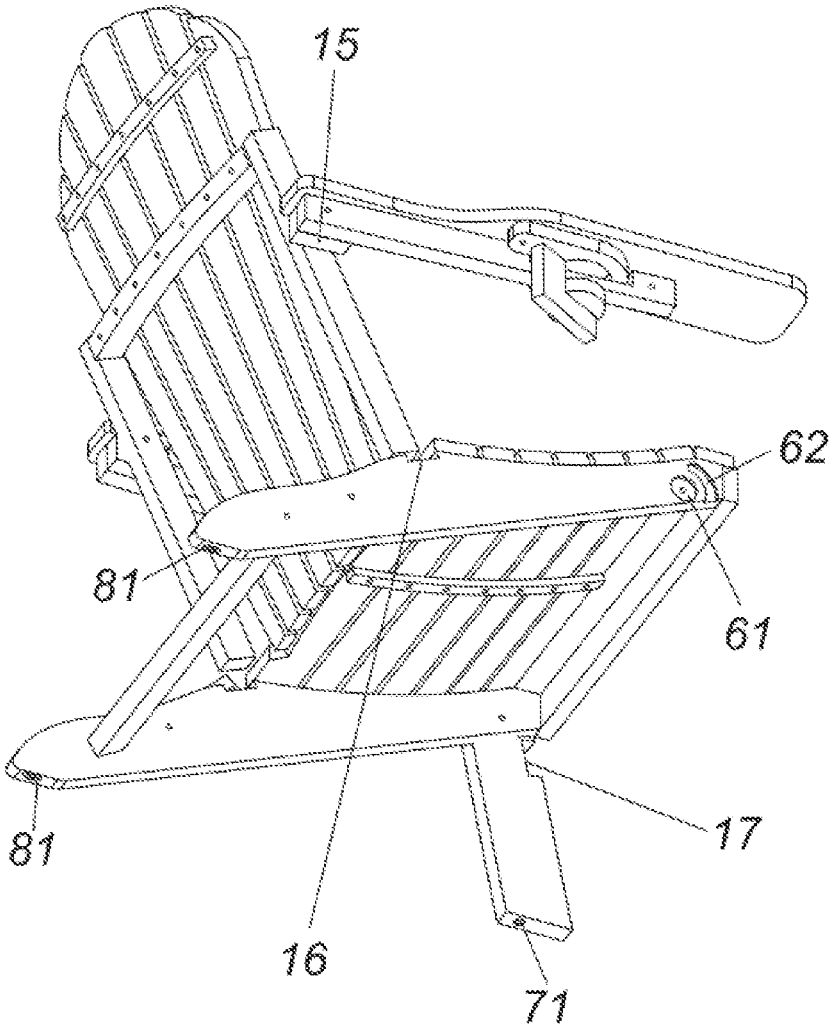
FIG. 3 is a three-dimensional view of an outdoor chair structure III.
Figure 4:
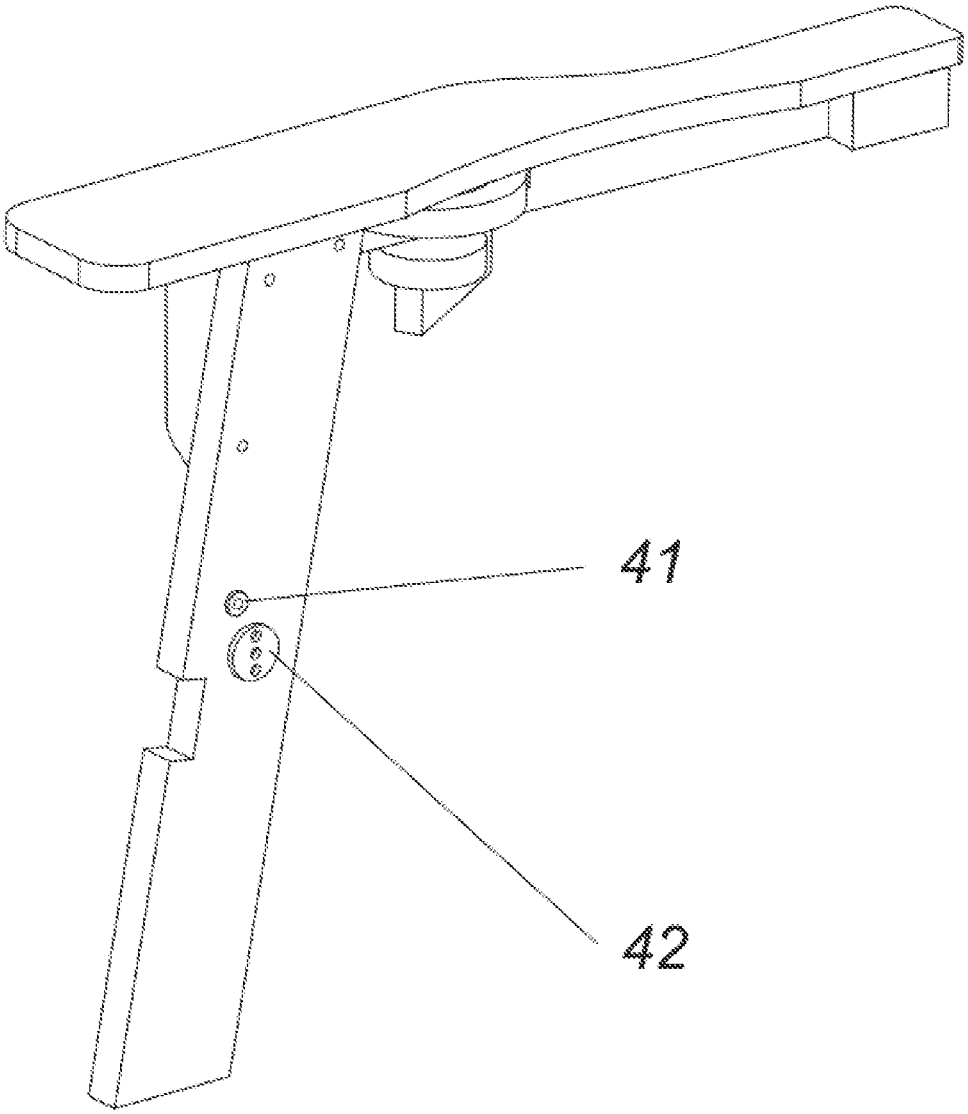
FIG. 4 is a schematic diagram of the structure of the front support leg.
Figure 5:
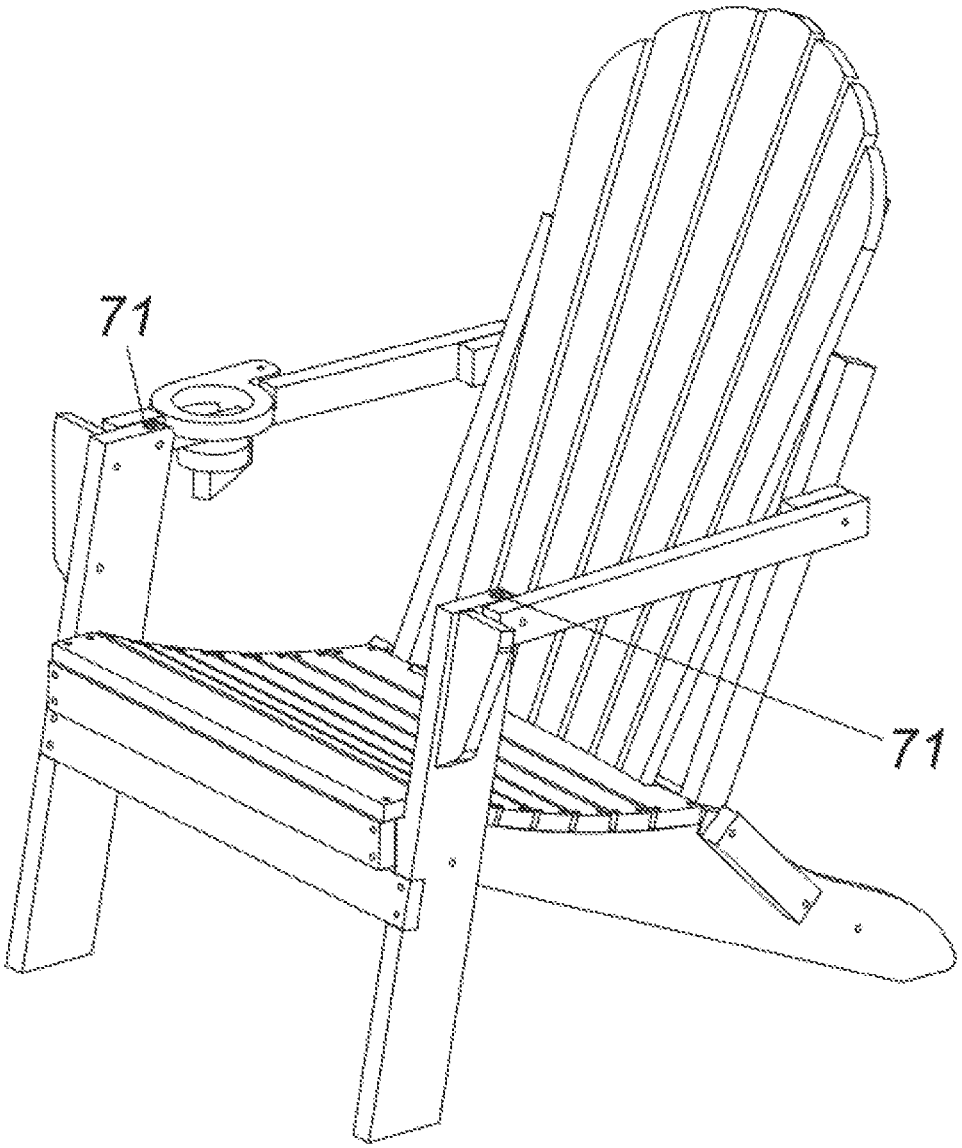
FIG. 5 is a three-dimensional view of the structure of an outdoor chair IV.
Figure 6:
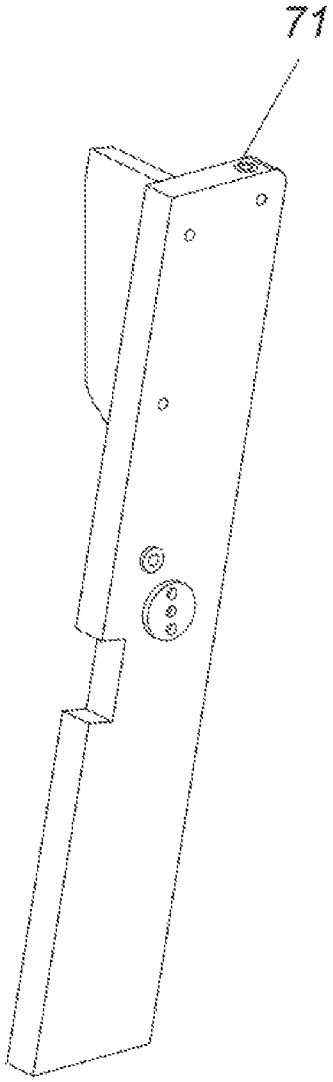
FIG. 6 is a schematic diagram of the detailed structure of the front support leg I.
Figure 7:
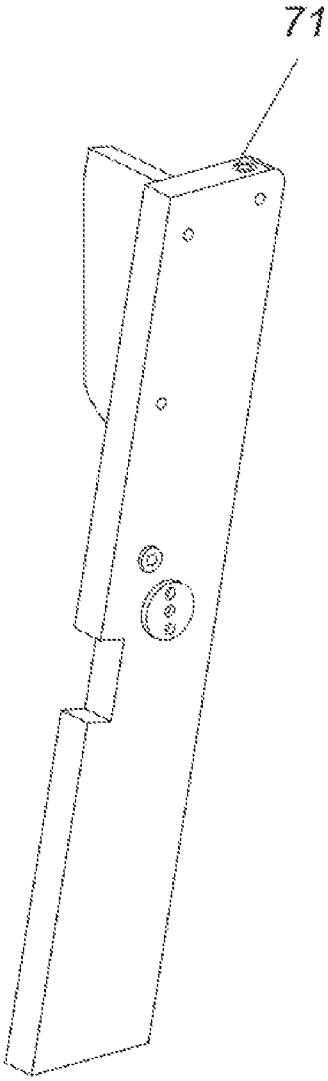
FIG. 7 is a schematic diagram of the detailed structure of the front support leg II.
Figure 8:
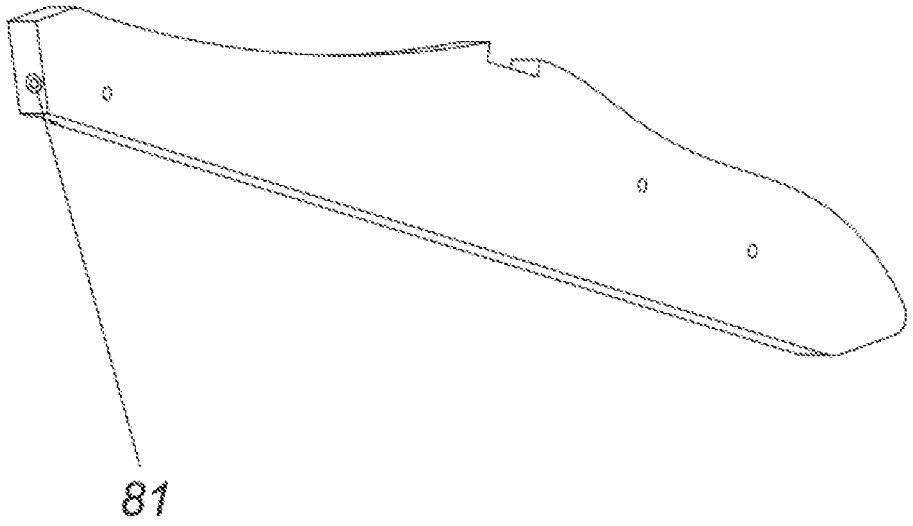
FIG. 8 is a schematic diagram of the detailed structure of the rear support leg I.
Figure 9:
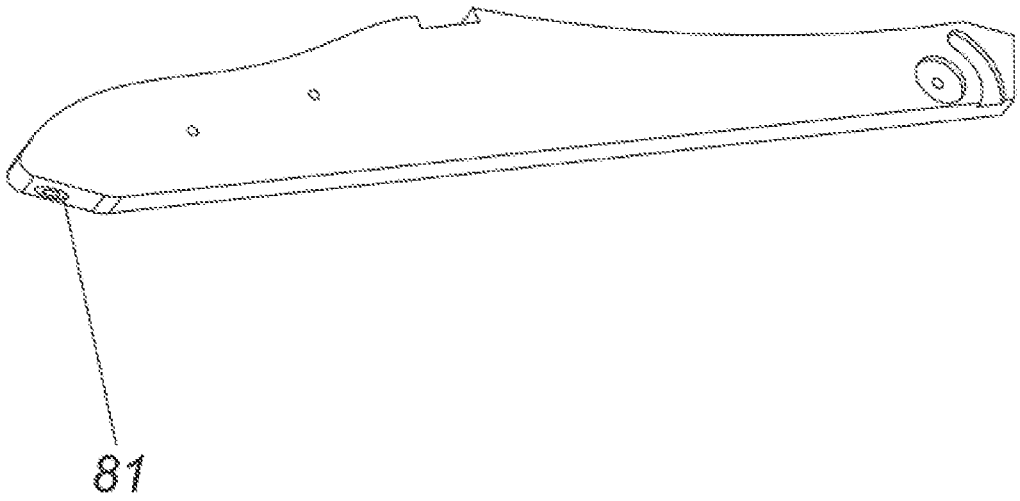
FIG. 9 is a schematic diagram of the detailed structure of the rear support leg II.

As shown in FIG. 1-FIG. 9, An outdoor chair comprising a chair body, wherein the chair body is provided with a front support leg 4 on both sides, the front support leg 4 is provided with a rear support leg 6 extending backward from the side of the front support leg 4, the front support leg 4 and the rear support leg 6 are connected by a pivot axis, and the front support leg 4 can be rotated and folded about the pivot axis, the front support leg 4 is provided with a slot 61 and a curved mounting path 62 at the connection of the front support leg 4 and the rear support leg 6, wherein the front support leg 4 can be rotated and the front support leg 4 can be rotated and folded around the pivot axis, where in the front support leg 4 is provided with the slot 61 and the curved mounting path 62 at the connection of the front support leg 4 and the rear support leg 6, and the front support leg 4 is provided with a large spacer 42 corresponding to the slot 61, a small spacer 41 capable of sliding on the curved mounting path 62, wherein the small spacer 41 is capable of sliding on the curved mounting path 62, and wherein the large spacer 42 corresponds to the slot 61, and the small spacer 41 is capable of sliding on the curved mounting path 62, wherein the small spacer 41 is capable of sliding on the curved mounting path 62, the large spacer 42 and the small spacer 41 are screwed to the front support leg 4, the spacer is capable of sharing the screw pressure when outdoor chair is used, when the chair is placed, the small spacer 41 moves in the curved mounting path 62 and finally moves to the top of the curved mounting path 62, when the Outdoor Chair is stored, the small spacer 41 moves together with the curved mounting path 62, thereby reducing the possibility of deformation and loosening of the threaded hole, and the above-mentioned structure is not easily deformed and loosened when the threaded hole is used, thereby making the assembly of the chair legs more solid and giving the user a better experience of use.

Wherein the chair body comprises a chair seat 2, an armrest 3, a chair back 1, a load bearing plate 10, a first fixing rod 9, a second fixing rod 8, a connecting rod 11, a first baffle 12, a second baffle 13, the chair back 1 is provided on both sides with, a side plate 7, a fixing block 14, a padded plate 15, the armrest 3, and the chair seat 2 is provided on both sides with, the front support leg 4, the rear support leg 6, the support block 5.

Wherein the armrest 3 is provided on both sides of the chair back 1, the armrest 3 includes an armrest plate 31, an armrest support plate 32, a cup holder assembly, the side wall of the armrest support plate 32 is provided with a slot, the cup holder assembly includes a cup support ring 312, a cup support bottom 313, a connecting block 311, the cup support ring 312 is provided in a coaxial arrangement with the cup support bottom 313, the cup resting bottom 313 is connected to the bottom surface of the cup resting ring 312 through the connecting block 311, the cup resting bottom 313 is connected to the bottom surface of the cup resting ring 312 through the connecting block 311, the cup resting ring 312 is connected to the pivot connection of the armrest plate 31, the cup resting ring 312 rotates through the pivot into the side wall slot of the armrest support plate 32, the cup resting ring 311 is hidden in the bottom surface of the armrest plate 31, and the cup resting bottom 313 is located below the armrest support plate 32.

Wherein the armrest support plate 32 is connected to the front support leg 4 by means of a pivot axis, and when the Outdoor Chair is put away, the front support leg 4 is rotated about the axis and the front support leg 4 is folded towards the chair back 1.

Wherein the chair back 1 is screwed to the first mounting rod 9 and the chair back 1 is screwed to the second mounting rod 8, wherein the chair back 1 is arranged along the length of the first mounting rod 9 or the second mounting rod 8, and wherein the chair back 1 is made of plastic, wood or metal.

Wherein the upper end of the side plate 7 is fixedly connected to the second fixing rod 8 and the bottom of the lower end of the side plate 7 is fixedly connected to the load bearing plate 10.

Wherein the rear support leg 6 is provided with a first groove 16, the load bearing plate 10 is placed in the first groove 16, one end of the fixing block 14 is pivotally connected to the rear support leg 6, the other end of the fixing block 14 is pivotally connected to the load bearing plate 10, the rear support leg 6 is rotatable about an axis, folded in the direction of the chair back 1, the rear support leg 6 is screwed to the connecting rod 11, and the end face of the other end of the rear support leg 6 is screwed to the first baffle 12.

Where in the armrest support plate 32 is secured to the underside of the armrest plate 31, the armrest support plate 31 is provided with the padded plate 15 between one end of the armrest support plate 31 and the side plate 7, and the pivot shaft passes through the armrest support plate 31 and the padded plate 15 to connect with the side plate 7, and when outdoor Chair is put away, the armrest 3 is rotated about the shaft so that armrest 3 is folded in the direction of chair back 1.

Wherein the armrest support plate 32 is secured to the underside of the armrest plate 31, the armrest support plate 31 is provided with the padded plate 15 between one end of the armrest support plate 31 and the side plate 7, and the pivot shaft passes through the armrest support plate 31 and the padded plate 15 to connect with the side plate 7, and when the outdoor chair is put away, the armrest 3 is rotated about the shaft so that the armrest 3 is folded toward the chair back 1.

Where in the chair seat 2 material is plastic, wood or metal.

Wherein the front support leg 4 is provided with a first support rod 71, the first support rod 71 extending downward along the upper surface of the front support leg 4 to the lower surface of the front support leg 4 throughout the height direction of the entire front support leg 4, and the first support rod 71 being made of metal such as iron, copper and the like which can provide stronger rigidity and support strength to give a better support effect to the armrest plate 31 so that the armrest is not easily deformed and the use of the armrest lasts for a longer time, giving the user a better use experience.

Wherein said rear support leg 6 is provided with a second support rod 81, said second support rod 81 extending backward along the upper surface of said rear support leg 6 to the lower surface of said rear support leg 6 along the longitudinal direction of the entire rear support leg 6, and said second support rod 81 being made of metal such as iron, copper and the like, which can provide stronger rigidity and support strength, provide higher support strength, adapt to different weights of people with higher safety coefficients, and give the user a better experience of using the apparatus.

The technical means disclosed in the scheme of the present invention are not limited to the technical means disclosed in the above embodiments, but also include the technical scheme consisting of any combination of the above technical features. It should be noted that, for those skilled in the art, various improvements and embellishments can be made without departing from the principle of the present invention, and these improvements and embellishments are also considered to be within the scope of protection of the present invention.

The invention has now been described in detail for the purposes of clarity and understanding. However, those skilled in the art will appreciate that certain changes and modifications may be practiced within the scope of the appended claims.

What is claimed is:

1. An outdoor chair comprising:

a chair body;

said chair body comprising:

a chair back (1) and a chair seat (2);

each side of the chair back provided with a side plate (7), a padded plate (15), a fixing block (14) and an armrest (3);

each side of the chair seat (2) provided with a front support leg (4) including a support block (5) and a rear support leg (6);

a second fixing rod (8) fixedly connected to an end of each support plate (7);

a connecting rod (11) connecting the rear support legs (6);

a first baffle (12) connected to a front end of each rear support leg;

a second baffle (13) connected to the front support legs (4);

each armrest comprising an armrest plate (31) and an armrest support plate (32) provided under the armrest plate (31) wherein a slot is provided in the armrest support plate (32) which receives a cup support ring of a cup holder assembly.

2. The outdoor chair according to claim 1, wherein the cup holder assembly comprises the cup support ring, a cup support base, a connecting block, the cup support base being connected to a lower surface of a cup support ring via the connecting block, the cup support ring being pivotally connected to the armrest plate, the cup support ring being pivotally rotated into a slot in the side wall of the armrest support plate, the cup support ring being hidden on the lower surface of the armrest plate, the cup support base being located below the armrest support plate.

3. The outdoor chair according to claim 2, wherein the armrest support plate is connected to one front support leg by a first pivot axis, and said one front support leg is rotatable about said first pivot axis to be folded towards a back of the outdoor chair.

4. The outdoor chair according to claim 2, wherein the armrest support plate is fixed to the lower surface of the armrest plate, the armrest support plate is provided with a padded plate between one end of the armrest support plate and the side plate, and a rotary shaft passes through the armrest support plate and the padded plate to be connected to the side plate.

5. The outdoor chair according to claim 1, wherein each front support leg is provided with a first support rod, the first support rod extending downwardly along a top surface of a respective front support leg to a bottom surface of respective front support leg throughout a height direction.

6. The outdoor chair according to claim 5, wherein each first support rod extends the entire height of its respective front support leg.

7. The outdoor chair according to claim 1, wherein an upper end of each said side plate is fixedly connected to said second fixing rod and a bottom of a lower end of each said side plate is fixedly connected to a load bearing plate.

8. The outdoor chair according to claim 7, wherein each said rear support leg is provided with a first groove, said load bearing plate is placed in said first grooves, said fixing blocks are connected at one end to one said rear support leg on a second pivot axis connected at the other end to said load bearing plate, and said rear support legs can be rotated around the second axis and folded in a direction of said chair back.

9. The outdoor chair according to claim 8, wherein the rear support legs are screwed to the connecting rod and an end face of each rear support leg is screwed to the first baffle.

10. The outdoor chair according to claim 1, wherein each support block is fixed to one front support leg for supporting a respective armrest plate, each front support leg is provided with a second groove, the second baffle is placed in the second grooves of the front support legs, and the second baffle plate is screwed to the front support legs.

11. The outdoor chair according to claim 1, wherein said chair back is arranged along the length of said first fixing rod or second fixing rod, said chair back being made of plastic, wood or metal.

12. The outdoor chair according to claim 1, wherein the chair seat is arranged along the length of the rear support legs, said chair seat being made of plastic, wood or metal.

13. The outdoor chair according to claim 1, wherein each said rear support leg is provided with a second support rod, said second support rod extending rearwardly along the top surface of said respective rear support leg to the bottom surface of said respective rear support leg along the entire length of said respective rear support leg.

14. The outdoor chair according to claim 1, wherein one end of each support block is connected to one front support leg and the other end is connected to an armrest support plate spindle, wherein the support blocks are rotatable by means of the spindle.

15. An outdoor chair comprising a chair body;

said chair body comprises a chair back, a chair seat and side plates, said chair back being provided on both sides with a fixing block, a padded plate, an armrest, said chair seat being provided on both sides with a front support leg, a rear support leg and a support block, a load bearing plate being provided on the bottom of said side plate, a first fixing rod being screwed to said chair back, a second fixing rod extends between upper ends of the side plates, a connecting rod being connected to said rear support legs, a first baffle being connected to the front end of said rear support legs, a second baffle being connected to said front support legs, each armrest comprises an armrest plate, an armrest support plate and a cup holder assembly, each armrest plate being provided on one side of the chair back with the armrest support plate being provided under the armrest plate, the armrest support plate being provided with a slot in a side wall, the slot receiving a cup support ring of the cup holder assembly, each said front support leg having one rear support leg extending from its side, with each said front support leg connected to a respective rear support leg by a pivot axis such that said front support legs can be rotated and folded about said pivot axis, said front support legs provided with a slot and a curved mounting path at the junction with said rear support legs, said front support legs provided with a first spacer corresponding to said slot and a second spacer which can slide on said curved mounting path, wherein the first is larger than the second spacer.

16. The outdoor chair according to claim 15, wherein said first spacer and said second spacer can jointly share the pressure borne by a bolt, thereby reducing the possibility of deformation and loosening of a threaded hole, and the outdoor chair is not deformed and loosened by the threaded hole when the outdoor chair is in use, so as to make the assembly of the legs of the chair solid.

17. An outdoor chair according to claim 15, wherein the first spacer and the second spacer are made of wear resistant material.

* * * * *